US006065254A

United States Patent [19]

Lanka

[11] Patent Number: 6,065,254

[45] Date of Patent: May 23, 2000

[54] ADJUSTABLE, FOLDABLE SUPPORT BRACE

[76] Inventor: Richard Lanka, 28952 Homewood Dr., Wickliffe, Ohio 44092

[21] Appl. No.: 09/272,794

[22] Filed: Mar. 19, 1999

[51] Int. Cl.[7] ..... E04G 25/04; E04G 17/14

[52] U.S. Cl. ..... 52/127.2; 52/36.4; 52/149; 52/749.1; 52/749.13; 248/354.3; 248/354.5

[58] Field of Search ..... 52/127.2, 149, 52/150, 749.1, 749.13, 36.4; 248/354.3, 354.5

[56] References Cited

U.S. PATENT DOCUMENTS

| | | | |
|---|---|---|---|
| 2,511,584 | 6/1950 | Hill . | |
| 2,687,268 | 8/1954 | Hawes | 248/354.5 X |
| 2,777,660 | 1/1957 | Albrecht | 248/354.5 |
| 2,832,559 | 4/1958 | Hillberg . | |
| 2,945,662 | 7/1960 | Jennings . | |
| 3,154,833 | 11/1964 | Kimball . | |
| 3,171,627 | 3/1965 | Tapley et al. | 248/354.5 X |
| 3,504,880 | 4/1970 | Toms | 248/354.3 |
| 3,728,838 | 4/1973 | Stout . | |
| 3,817,006 | 6/1974 | Williams . | |
| 3,908,956 | 9/1975 | Gates . | |
| 4,000,592 | 1/1977 | Kelly . | |
| 4,068,427 | 1/1978 | Camardo . | |
| 4,070,833 | 1/1978 | Hancock . | |

*Primary Examiner*—Christopher T. Kent
*Attorney, Agent, or Firm*—Fay, Sharpe, Fagan, Minnich & McKee, LLP

[57] ABSTRACT

A foldable and portable support brace is provided for supporting masonry walls during construction. The brace includes a main frame, an optional ledge, and a support leg member. The ledge is a fold down ledge which is attached to a swinging ledge support. The support leg member includes a top section and a bottom section where the bottom section is attached to a length adjusting device. The length adjusting device has foldable periscope-type handles attached to an internally threaded fastener which rotates around a threaded screw. The threaded screw is pivotally connected to a footer base, which rests on the ground during use. The handle allows for easy lengthening and shortening of the support leg member, while also being foldable when not in use. The leg portion and ledge are collapsible into the main frame when the main frame is to be transported to another area or another site. Optionally, the main frame has an integral level.

20 Claims, 4 Drawing Sheets

ADJUSTABLE, FOLDABLE SUPPORT BRACE

FIELD OF THE INVENTION

The present invention relates to the art of support braces. It finds more particular application in the production of foldable support braces for use in commercial or home construction for temporarily supporting newly constructed masonry walls.

In this regard, the support braces are utilized to bolster masonry walls formed on the site (i.e. cast-in-place, etc.) during construction. For example, the present invention is useful for supporting concrete forms while the moist concrete is allowed to cure within the forms. This type of process is utilized to produce monolithic poured walls. Additionally, the braces can be used for supporting newly assembled masonry brick or block walls of approximately 8 feet or higher in order to inhibit wind damage and the like.

However, it will be appreciated that the invention has other applications such as holding up and supporting any vertical wall being formed is or used as a scaffolding support and it may be advantageously employed in other environments and applications.

BACKGROUND OF THE INVENTION

Concrete interior or exterior walls are generally produced through the use of two or more concrete wall forms that are set up in parallel and are interconnected by spacer bars. The spacer bars, along with exterior support braces, retain the forms in a parallel relationship while the concrete is being poured and the initial cure cycle is initiated.

To support the forms and to resist movement during concrete pouring or curing, wooded support braces can be utilized. However, the braces used in such wooded brace or prop systems are generally loosely constructed and provide non-uniform support. Additionally, such wooded braces are difficult to use in soft or hard soil conditions and/or result in a waste of lumber. Furthermore, wooden braces are time consuming to assemble and disassemble.

Recently, several types of reusable bracing systems have been developed. The adjustable, reusable bracing systems for concrete wall forms require multiple pieces for forming the final usable structure. Still others require that a separate device be built into the wall being constructed in order to attach the support brace thereto. The problem with these devices is they are not usually very easily collapsible and transportable from one site to another.

While certain support braces have been designed in an effort to overcome the forgoing deficiencies, they have not been successful. See, for example, U.S. Pat. Nos. 3,154,833; 2,945,662; 2,832,559; 3,817,006; 4,068,427; and 4,070,833.

One example of such bracing systems is a temporary, reusable shoring assembly for use in cast-in-place concrete construction. The aforesaid temporary reusable shoring assembly has vertical support sections with adjustable legs that provide for a separate piece that is abutted against a vertical supporting member. This piece is not an attached collapsible member of the support. The horizontal bracing elements are also made from a solid unitary construction and are not foldable into the main vertical section. Therefore, these types of support braces are not easily foldable and transportable for reuse at other job sites.

The present invention contemplates a new and improved apparatus and method which overcomes the above-referenced problems and other problems present in support brace construction.

SUMMARY OF THE INVENTION

It is an object of the subject invention to overcome the difficulties associated with prior art construction techniques and support braces. The present invention is directed to a temporary, foldable support brace which provides many benefits over the prior art. For example, the support brace of the invention does not require the use of heavy equipment in that the support base can be easily assembled and disassembled by a single laborer. In addition, all of the components of the support brace are interconnected in such a manner which allows for the support brace to be easily assembled or disassembled for storage or travel.

The present invention contemplates a foldable support brace for use in construction projects which can be readily assembled, disassembled and reused. The brace includes a main frame for supporting an area of the construction project, such as interior or exterior vertical walls, an optional ledge with a swing ledge support, a support leg apparatus, a length adjusting device for adjusting a length of the support leg apparatus, and a base foot which is located on a ground surface and which supports an end of the length adjusting device.

In accordance with a more limited aspect of the present invention, the support leg apparatus includes a top portion and a bottom portion that are connected by a connecting device.

In accordance with a further limited aspect of the present invention, the length adjusting device includes a screw or threaded section, an internally threaded fastener for receiving the screw or threaded section, and a handle section. By rotating the screw or threaded section through the use of the handle section, the effective length of the length adjusting device is altered. For example, when the handle section is turned clockwise the support leg apparatus can be lengthened and when the handle section is turned counterclockwise the support leg apparatus can be shortened.

In accordance with an even more limited aspect of the current invention, the handle section includes a periscope-grip type handle comprising two foldable portions which are downwardly extended and gripped during length adjustment and folded upwardly and inwardly between length adjustments.

In a further limited aspect of the current invention, the swing ledge support, the support leg apparatus, and the base foot all collapse into the rear cavity of the main frame, which further includes a handle device for carrying the foldable support brace.

One advantage of the present invention is that a reusable support brace for construction is easily collapsible and transportable. Once the forms for the interior or exterior walls are assembled and/or the brick or block wall is provided, the support brace of the present invention can be easily engaged, thereby providing vertical support to the walls as the moist concrete is allowed to cure.

Another advantage of the present invention is the inclusion in the brace a built in level for ease of leveling.

Yet another advantage of the present invention is that the periscope-type handle section on the length adjusting device functions to allow easy lengthening or shortening of a support leg.

A still further advantage of the present invention is that the lengthening or shortening device is connected to the support leg at a position which allows for increased rigidity when the brace is being used.

Yet a further advantage of this invention is to provide a temporary, foldable support brace which is relatively simple in construction, economical to manufacture and efficient in operation. The brace can be easily assembled and disassembled by relatively unskilled laborers in a few minutes. Additionally, the brace is easily transferable and can be reused essentially indefinitely.

Other advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components. The drawings are only for purposes of illustrating the preferred embodiments and are not to be construed as limiting the invention, where.

DETAILED DESCRIPTION OF THE PREFERRED EMBODIMENT

Figure 1:
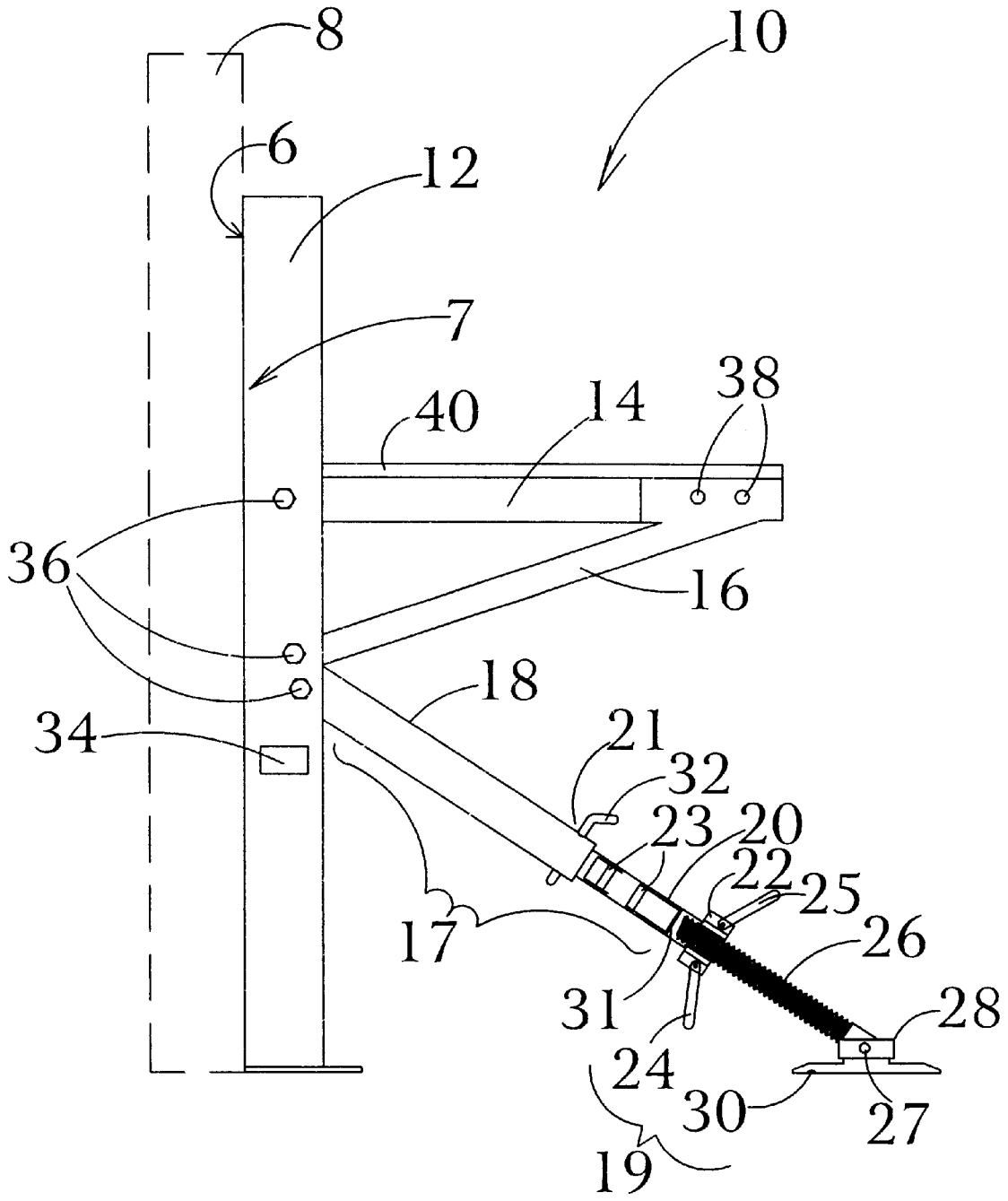
FIG. 1 illustrates an unfolded side view of the support brace of the present invention.

Turning now to the drawings, wherein the showings are for purposes of illustrating a preferred embodiment of the invention only and not for limiting the same, FIG. 1 shows a portable wall support brace 10.

The brace 10 is shown in an assembled and unfolded state next to a side wall of a form structure 8 referenced in phantom. Alternatively, form structure 8 can also represent a newly assembled brick, block, or other type of masonry wall.

The brace 10 includes a vertical main frame rail 12, an optional fold down ledge 14 with a swinging ledge support 16, and a leg support member 17 with a top portion 18 and a bottom portion 20.

Figure 2A:
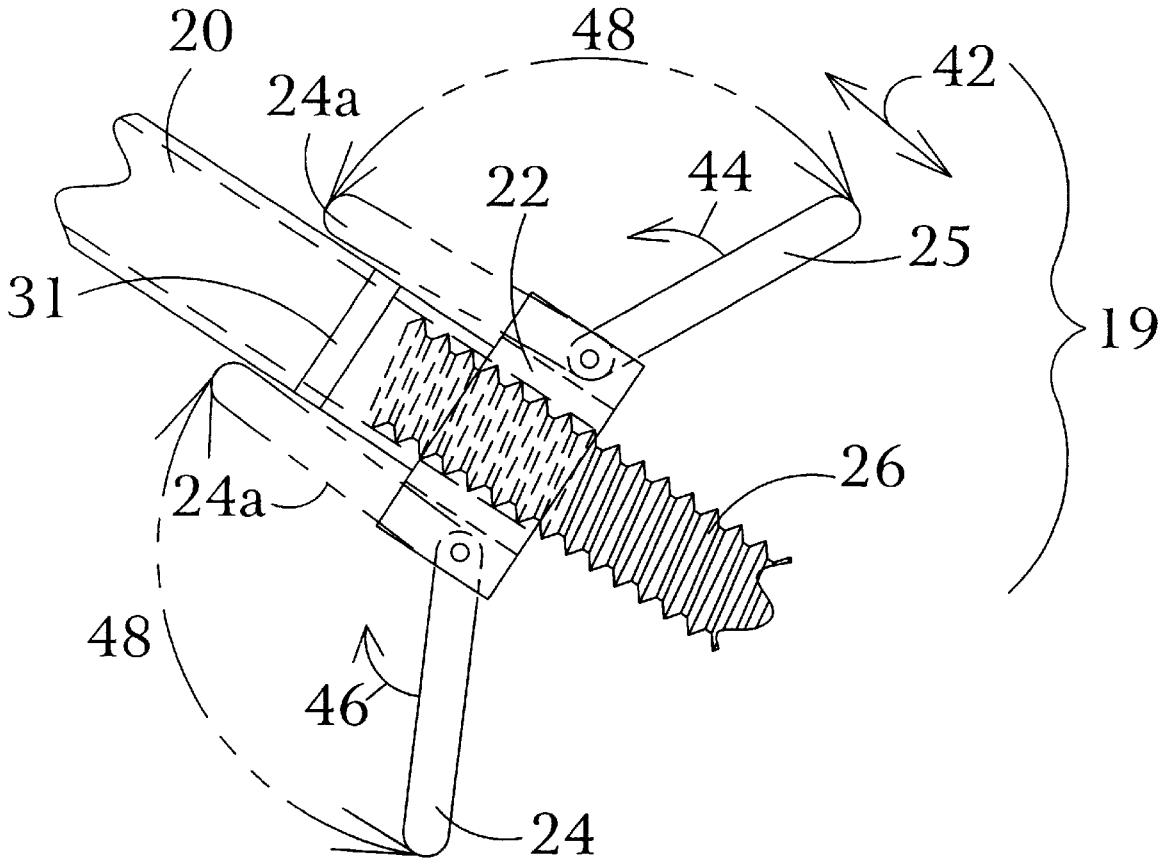
FIG. 2*a* illustrates an exploded view of a length adjusting means.

The bottom portion 20 of the leg support member is connected to a length adjusting device or member 19 which includes an internal threaded fastener 22 with a threaded receptacle, periscope folding handles 24 and 25, which fold upwardly and inwardly to position 24*a* shown in phantom in FIG. 2*a,* and a threaded screw body 26. The threaded screw body 26 is inserted into an elongated opening of the lower leg portion 20 which allows the internal threaded fastener 22 advance up and down the screw section 26. The end of 27 of threaded screw body 26 is pivotally supported by a screw holder 28 on the footer base 30.

The footer base 30 is positioned on the ground and supports the support leg apparatus 18, 20 during use of the brace 10. Optionally, footer base 30 may be staked into the ground.

The main frame rail 12 is preferably made of steel or aluminum channel material or the like having a front face plate 6 and rear cavity 7. The channel structural shape provides strength while also providing a cavity 7 into which the support leg 17 and optional fold down ledge 14 may be optionally collapsed into. The main frame rail 12 may further optionally include a handle device (not shown) for carrying the portable wall support brace 10.

Figure 3:
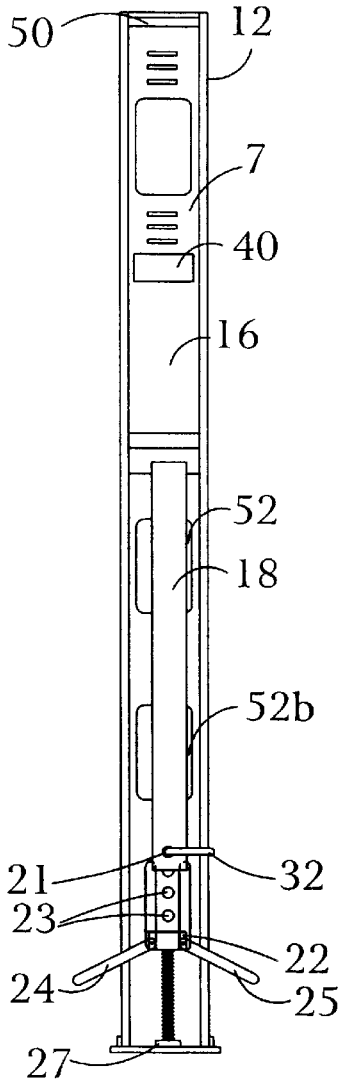
FIG. 3 illustrates a back view of the unfolded support brace.

The top leg section or member 18 and the bottom leg section or member 20 of the leg support member 17 are connected using a connector member 32, such as a pin, that can be removed to disassemble the leg 18, 20. The top leg section 18 has an elongated opening running at least partially through its length where the bottom section 20 is inserted into this opening when the two section are connected. This forms a telescopic-like assembly of the top 18 and bottom 20 sections. Connector member 32 is then inserted through aperture 21 in the top leg 18 though one of the selected apertures 23 in bottom leg 20. This provides for a rough adjustment of the length of the leg support member 17. See FIGS. 1 and 3.

Preferably, the main frame 12 optionally includes a integral level device 34 to allow for easy alignment of the support brace 10 during use. The level device 34 also assists in the rough adjustment of the length of leg support member 17.

The preferred fold down ledge 14, swinging ledge support 16, and support leg top portion 18 are all pivotally attached to the main frame 12. This is preferably through use of carriage bolts 36. However, as it is understood by one skilled in the art, other optional securing or fastening devices may also be incorporated here.

Further, the connecting section of the fold down ledge 14 and the swinging ledge support 16 includes safety rail holes 38 to allow for safety rail attachments during use of the brace 10. Also, the fold down ledge 14 can include a wooden insert 40 if the brace 10 is being used for scaffolding.

Optionally, the fold down ledge 14 and swing ledge support 16 are constructed in such a manner which allows the components to be pivotally collapsed into the rear cavity 7 of the main frame rail 10. This allows for all of the components of brace 10 to be collapsed into the rear cavity 7 of the main frame for storage or travel.

Turning now to FIG. 2*a,* there is shown an exploded view of the length adjusting device 19 in FIG. 1. This length adjusting device functions to produce fine length adjustment (i.e. fine tuning of the length) by first unfolding the periscope handles 24 and 25 from their folded position 24*a*. The length of the leg 18, 20 can then be adjusted in small increments, which enables the brace 10 to support different angled walls or to finely adjust the brace to support vertical walls. The length can be adjusted either up or down by the threaded screw 26, as shown by arrow 42.

In this regard handles 24 and 25 when engaged form a T-shape handle which facilitates rotation of fastener 22 around threaded screw 26. For example, the length of the legs 18, 20 can be made longer by turning the handles 24 and 25 in a counterclockwise direction 44. Alternatively, to shorten the leg 18, 20, the handles are turned in a clockwise direction 46. When the adjustments are completed, the handles 24 are folded in direction 48 into their folded position 24*a*.

By having the leg 18, 20 attached to the length adjusting means 22, 24, 26 at this location the length can be more easily adjusted in view of the prior art systems. Further, the leg 18, 20 and length adjusting means 22, 26 are located relative to each other to form a stronger connection making the brace 10 more rigid and allowing the connection, and the brace 10, to withstand more force or stress at this connection compared to the prior art systems during use.

Further, by having handles 24, which can collapse to position 24*a,* the chance of accidents, through the handle 24 being hit during the construction, is decreased, and almost eliminated. Also, this periscope function of the handles 24 allows for ease of use since less torque needs to be exerted during the lengthening and shortening steps.

Figure 2B:
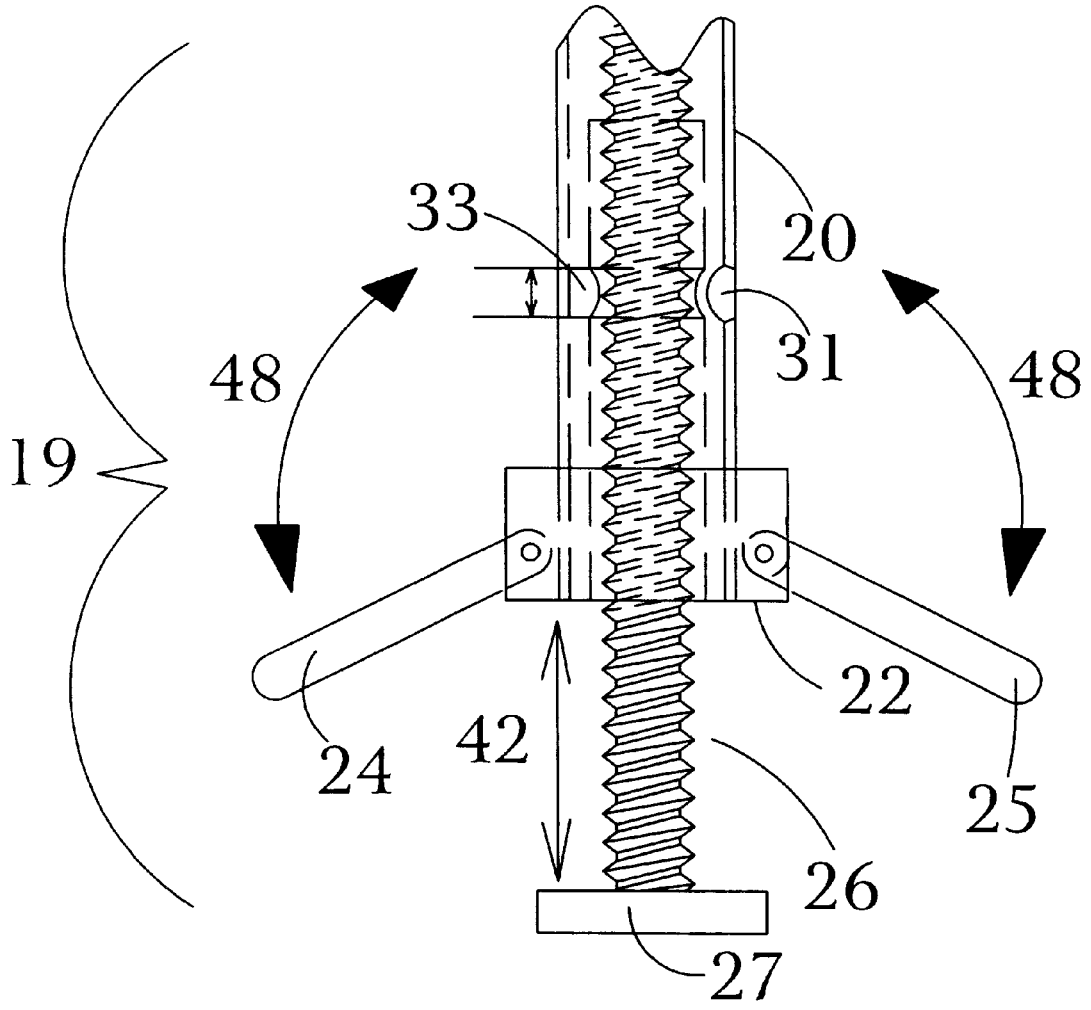
FIG. 2*b* shows a cross-sectional view of the length adjusting means of FIG. 2*a;*

Additionally, as illustrated in FIG. 2*b,* length adjustment means 22 is fastened to bottom leg section 20 by crimp or indentation 31. This indentation 31 rests in groove 33 of length adjustment means 22 in such a manner to allow for rotational in bottom leg section 20. Moreover, handles 24 and 25 are rotatably fastened to fastener 22 in an offset arrangement thereby prohibiting handles 24 and 25 from dropping completely down into a vertical position.

Figure 4:
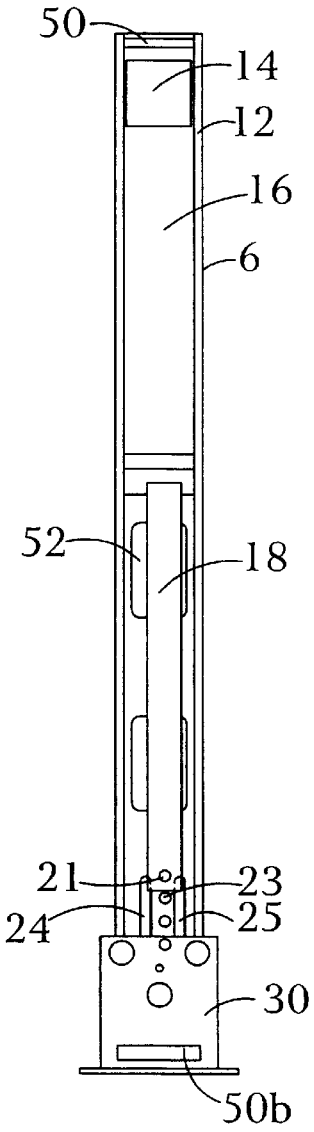
FIG. 4 illustrate a back view of the folded (or collapsed) support brace; and, FIG. 5 illustrates a side view of the folded support brace.
Figure 5:
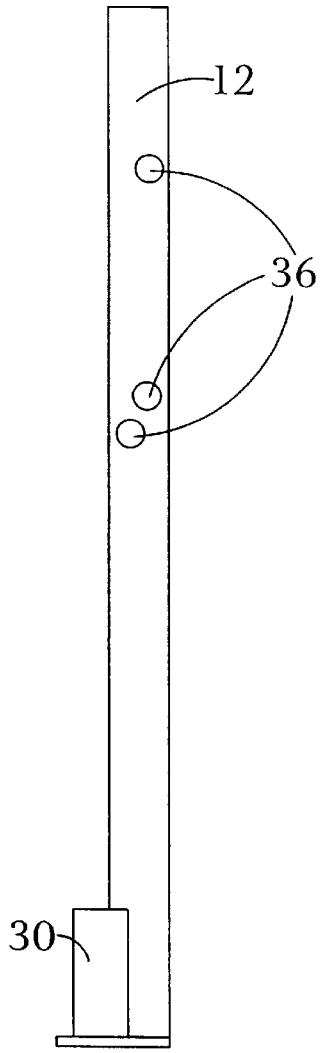

Turning now to FIGS. 4 and 5, the folded state of support brace 10 will be described in more detail. When the support 10 needs to be moved from one area to another at a construction site, or to another construction site, it can be easily collapsed. This is accomplished by folding down ledge 14 and swing arm 16 into the main frame 12. Next, the top leg portion 18 pivots with respect to the main frame 12 through bolt 36 collapsing it into the main frame 12. With the top leg section 18 folded in, the bottom leg section 20, the length adjusting means 22, 24, 26 and the footer base 30 can also be folded or collapsed into the main frame 12. The footer base 30 is further folded upwards at connection 28 to allow for a very compact, portable state of the support brace 10. The main frame 12 has handles 50, 50*b* at either end or, handles 52, 52*b* along main frame 12, to aid in the carrying of the support brace 10. Therefore, the support brace 10 of the present embodiment can be easily folded and transported.

The invention has been described with reference to the preferred embodiment. Obviously, modifications and alterations will occur to others upon reading and understanding the proceeding detailed description. It is intended that the invention be construed as including all such modifications and alterations insofar as they come within the scope of the appended claims or the equivalents thereof.

Having thus described the preferred embodiment, the invention is now claimed to be:

1. A reusable, foldable, and portable support brace for use in supporting a newly constructed and vertically disposed masonry wall, the brace comprising:

a main frame having a front vertical face member for supporting the newly constructed and vertically disposed masonry wall and a rear channel member;

a support leg member pivotally connected to said rear channel member of the main frame;

a length adjusting device included in the support leg member for adjusting a length of the support leg member; and, a base foot which is for being located on a ground surface and which supports an end of the length adjusting device;

wherein, the support leg member includes a top portion and a bottom portion which are interconnected by a connector member, wherein the top portion is pivotally connected to the main frame and the bottom portion is further connected to the length adjusting device; and, wherein the length adjusting device includes a threaded screw, an internally threaded fastener receiving the threaded screw, and a periscope handle section, wherein when the periscope handle section is rotated the length of the support leg member is adjusted.

2. The brace according to claim 1, further wherein:

the periscope handle section includes two foldable portions which are extended and gripped during length adjustment and folded upwardly and inwardly between length adjustments.

3. The brace according to claim 2, further wherein:

the internally threaded fastener advances down the threaded screw section, which is fed into an elongated opening running through a length of the bottom section, during the clockwise rotation and the internally threaded fastener advances up the threaded screw section during the counter-clockwise rotation.

4. The brace according to claim 3, further wherein the brace includes a ledge with a swing ledge support.

5. The brace according to claim 4, further wherein:

the swing ledge support, the support leg member, and the base foot all collapse into the main frame.

6. The brace according to claim 1, further wherein the main frame has an integral level.

7. The brace according to claim 1, further wherein:

a swing ledge support, the support leg member, and the base foot all collapse into the main frame which further includes a handle device for carrying the foldable support brace.

8. The brace according to claim 1, further wherein:

the top portion of the support leg has an elongated opening running at least partially through a length of the top portion and wherein the bottom portion is inserted into the elongated opening when they are connected together.

9. A reusable, foldable, and portable support brace for use in supporting one or more forms for producing a newly constructed and vertically disposed masonry wall, the brace comprising:

a main frame having a front vertical face member for supporting one or more forms for producing a newly constructed and vertically disposed masonry wall and a rear channel member;

a support leg member pivotally connected to said rear channel member of the main frame;

a length adjusting device included in the support leg member for adjusting a length of the support leg member; and, a base foot which is for being located on a ground surface and which supports an end of the length adjusting device;

wherein, the support leg member includes a top portion and a bottom portion which are interconnected by a connector member, wherein the top portion is pivotally connected to the main frame and the bottom portion is further connected to the length adjusting device; and, wherein the length adjusting device includes a threaded screw, an internally threaded fastener receiving the threaded screw, and a periscope handle section wherein when the periscope handle section is rotated the length of the support leg member is adjusted.

10. The brace according to claim 9, further wherein:

the periscope handle section includes two foldable portions which are extended and gripped during length adjustment and folded upwardly and inwardly between length adjustments.

11. The brace according to claim 10, further wherein:

the internally threaded fastener advances down the threaded screw section, which is fed into an elongated opening running through a length of the bottom section, during the clockwise rotation and the internally threaded fastener advances up the threaded screw section during the counter-clockwise rotation.

12. The brace according to claim 11, further wherein the brace includes a ledge with a swing ledge support.

13. The brace according to claim 12, further wherein:

the swing ledge support, the support leg member, and the base foot all collapse into the main frame.

14. The brace according to claim 9, further wherein the main frame has an integral level.

15. The brace according to claim 9, further wherein:

a swing ledge support, the support leg member, and the base foot all collapse into the main frame which further includes a handle device for carrying the foldable support brace.

16. The brace according to claim 9, further wherein:

the top portion of the support leg has an elongated opening running at least partially through a length of the top portion and wherein the bottom portion is inserted into the elongated opening when they are connected together.

17. A reusable, foldable, and easily transported support brace for supporting a masonry wall during curing at a construction site, the brace comprising:

a main frame including a vertical face member for supporting the wall and a rear channel forming a back cavity in said main frame;

a support leg member comprising an upper section and a lower section said upper section being pivotally attached to the rear channel of the main frame further wherein the support lee member includes a length adjusting device connected to the lower section of the support lea member such that the support leg member is lengthened and shortened through the use of the length adjusting device, the length adjusting device including:

a threaded elongated device inserted into a threaded elongated opening in said lower section of said support leg member; and, a periscope handle device pivotally attached to a threaded ring shaped device wherein said threaded ring shaped device threadably engages said threaded elongated device, and, wherein the periscope handle device is folded when not in use and unfolded and rotated when in use, wherein by rotating in a clockwise direction the support leg member is shortened when the threaded ring-shaped device advances down the threaded elongated device and by rotating in a counter-clockwise direction the support leg member is lengthened when the threaded ring-shaped device is advanced up the threaded elongated device.

18. The brace of claim 17, wherein:

the lower and upper sections are detachably connected; and the length adjusting device is connected to a foot base.

19. The brace of claim 18, further wherein the support leg member collapses into the back cavity of the main frame at a pivot point whereby the brace is easily transported.

20. The brace of claim 18, further wherein:

the upper section of the support leg member has an elongated opening running at least partially through its length into which the lower section of the support leg member is inserted during use such that the upper and lower sections are connected near a first part of the elongated opening; and, the lower section has an elongated opening running at least partially through its length such that the threaded elongated device is inserted into and withdrawn from the elongated opening during lengthening and shortening of the length adjusting device.

* * * * *